United States Patent [19]

Giampetruzzi et al.

[11] Patent Number: 4,569,664

[45] Date of Patent: Feb. 11, 1986

[54] PLAYHOUSE

[76] Inventors: Jerry F. Giampetruzzi, 186 Cleenput Ter., Paramus, N.J. 07652; Owen C. Martin, Shomokin Rd., Highland Lakes, N.J. 07422

[21] Appl. No.: 463,122

[22] Filed: Feb. 2, 1983

[51] Int. Cl.[4] ..... A63H 33/08

[52] U.S. Cl. ..... 446/110; 446/114

[58] Field of Search ..... 446/108, 112–115, 446/476, 85, 122, 110, 127, 124, 478, 111; D21/114, 115, 116

[56] References Cited

U.S. PATENT DOCUMENTS

| | | | |
|---|---|---|---|
| 1,271,160 | 7/1918 | Groves | 446/106 |
| 1,867,374 | 7/1932 | Myers | 446/110 X |
| 3,185,480 | 5/1965 | Weyman et al. | 446/46 X |
| 3,751,848 | 8/1973 | Ahlstrand | 446/113 X |
| 4,107,869 | 8/1978 | Abrams | 446/115 X |

*Primary Examiner*—Mickey Yu

*Attorney, Agent, or Firm*—Edward R. Weingram

[57] ABSTRACT

A playhouse, easily assembled by a child of tender years requiring a minimum of parts and no fastening elements, and having a sufficient structural rigidity that it can be picked up and moved without collapsing. The playhouse comprises a plurality of flat structural members, two of which, when assembled, are vertical members adapted to coact and form a self-standing cross member. A third member having passageways therein adapted to register with the first and second members rests on horizontal intersecting surfaces of the vertical members assembled to form the cross member and adds rigidity to the assembly. The third member also has slots in the periphery which register with the vertical members forming the cross member. At least one of the vertical members has one portion spaced from another portion by a horizontal supporting surface. Both spaced portions have a shoulder at one end thereof which projects through slots in a roof panel. The playhouse is held together by interlocking panels and requires no fastening elements. Additional panels can be added. A floor may also be provided which is a flat structural member with slots in the periphery which register with the vertical panels. The playhouse is easily assembled and disassembled. When disassembled, all parts lie flat and occupy a minimal of space.

26 Claims, 4 Drawing Figures

PLAYHOUSE

BACKGROUND OF THE INVENTION

1. Field of the Invention

This invention relates to a playhouse requiring a minimum of parts, easily assembled by a child of tender years, and having sufficient structural rigidity that it can be picked up and moved without falling apart.

2. Prior Art

Playhouses provide much enjoyment for children because they simulate the ownership of a house which can be lived in and because they simulate exclusive possession in that the house may have play furnishings and small scale appurtenances. Many U.S. and foreign patents attest to the continued interest in providing playhouses suitable for children of tender years among which are the following.

U.S. Pat. No. 1,428,405 describes a toy house adapted to be readily set up or erected by a child as well as subsequently knocked down. The toy house described in this patent has a center wall or panel which is the backbone of the structure. To the lower end of the center wall are secured two base panels. Two vertical gable panels are hinged the center wall. Floor panels are also hinged to the center wall. The floor panels have notches which cooperate with notches in a corner piece attached to the gable panel and provide structural rigidity when assembled.

U.S. Pat. No. 3,946,520 describes a magnetically operable play doll set including a housing having a floorboard divided by walls into a plurality of rooms and doorways. The floorboard is very thin and is supported by a frame. The walls are secured to the frame through the floorboard by means of a clip having a pair of upstanding arms provided with opposed spaced apart inwardly directed engaging flanges. The arms extend upwardly through an appropriately located slot in the floorboard and the engaging flanges extend into apertures in the lower portion of one of the walls.

U.S. Pat. No. 3,751,848 describes a model house that can be erected from a combination of parts without tools or fasteners. All parts are rigid members that interlock so that they cooperate together to maintain the structural arrangement of the house.

U.S. Pat. No. 1,551,666 describes a toy building of simple construction that can be quickly assembled and disassembled by a child. The building has a center wall, sidewalls, a pair of roof sections secured to the center wall and sidewalls by cleats, a central floor, and stairs.

U.S. Pat. No. 4,107,869 describes a toy house formed by a plurality of interlocking panels. In one embodiment, the toy house is formed, without exterior walls, of panels which interlock by means of slots. In another embodiment, plastic fittings are used to hold the edges together, and in addition, bendable joints between panel sections are provided.

U.S. Pat. No. 3,906,659 describes a collapsible doll house constructed of a small number of individual panels which serve as walls, floors, roof, etc. The panels are provided with grooves and slots so that all panels slide together and support one another. The parts are held together by pegs inserted in matching holes in the panels.

British Pat. No. 1,219,584 describes a doll house made of paperboard material and assembled with tongue and slot and/or twin slot coupling connections. Plastic stiffening members line the slots to reinforce the connections.

British Pat. No. 1,220,350 describes a model building and, particularly, a kit for forming the building. The kit includes a tray filled with blocks defining slots therebetween which are perpendicular to the base of the tray and are adapted to receive the lower ends of extensions of the walls of the building to assist in maintaining the walls of the building upright and rigid.

While the doll house as described may be erected by a child, a fair amount of skill is involved and, in many cases, additional pieces are required to secure the structural members together.

SUMMARY OF THE INVENTION

The present invention sets forth a playhouse that requires a minimum of parts, is easily assembled by a child of tender years without using tools, and is selfsupporting and is easily moved by a child without collapse. The playhouse comprises first and second vertical structural members adapted to coact and form a selfstanding cross member and a horizontal member having passage ways therein adapted to register with the first and second vertical structural members. The first and second vertical structural members having horizontal surfaces adapted to coact with each other to provide intersecting horizontal support surfaces for the horizontal member. The horizontal member has slots in the periphery with which portions of the vertical structural members can coact to add rigidity to the assembled horizontal and vertical members. A roof panel having slots through which projecting portions of the vertical structural members extend can coact with the vertical structural members to further add rigidity to the assembled horizontal and vertical members. A second horizontal member having slots in the periphery with which portions of the vertical structural members can coact may be provided to serve as a base or floor of the playhouse.

The present invention also sets forth a method for assemblying a playhouse.

Accordingly, it is an object of the invention to provide a playhouse which is easy to assemble by a child of tender years.

It is another object of the invention to provide a playhouse which has interlocking parts to provide rigidity while still providing open access.

It is a further object of the invention to provide a playhouse which is sufficiently rigid that it enables placement of doorways and arches without weakening the completed structure.

It is a still further object of the invention to provide a playhouse which enables full access to the upper areas of the playhouse without compromising the rigidity of the structure.

It is yet another object of the invention to provide a playhouse which, when disassembled, occupies a minimum of space.

It is still another object of the invention to provide a playhouse which is relatively inexpensive to fabricate.

It is a further object of the invention to provide a playhouse which can be manufactured from a wide variety of materials.

It is a still further object of the invention to provide a playhouse which is relatively durable.

It is another object of the invention to provide a playhouse using identical parts or parts having minor modifications.

It is still another object of the invention to provide a playhouse requiring no external fastening elements to hold the parts together.

It is yet another object of the invention to provide a playhouse which uses various interlocking pieces.

A still further object of the invention is to provide a playhouse constructed with interlocking pieces which may be removed or omitted without substantially weakening the structure.

A still further object of the invention is to provide a playhouse with a removeable roof to permit greater access to the interior.

Another object of the invention is to provide a playhouse from which the roof may be removed without substantially affecting the structural integrity of the playhouse.

A further object of the invention is to provide a playhouse which may be disassembled by removing parts in any order without affecting the structural integrity of the remaining parts.

A still further object of the invention is to provide a playhouse in which access to various interior areas can be obtained from various angles.

Another object of the invention is to provide a playhouse requiring no exterior walls thus allowing full access to the interior.

It is yet another object of the invention to provide a playhouse which uses a tongue and groove construction to firmly fix each of the parts with relation to an adjacent part.

It is still another object of the invention to provide a playhouse using parts shaped in such manner as to facilitate the assembly thereof.

It is another object of the invention to provide a playhouse in which the parts interlock during assembly to provide structural rigidity to the partially assembled structure.

It is a further object of the invention to provide a method of assembling parts for a playhouse which is easy to follow for a child of tender years.

It is a still further object of the invention to provide a playhouse which can be assembled by a child of tender years and provides a satisfaction of accomplishment.

It is a still further object of the invention to provide a method of assembling a playhouse which enables the structure to have rigidity when in a partially completed state without requiring any fastening elements.

The foregoing and further objects of the invention will be apparent from the following description of the invention. However, although the invention will be described in connection with a preferred embodiment, other variations and modifications will be apparent to those skilled in the art. The invention is defined, therefore, in the claims following this specification.

DETAILED DESCRIPTION OF THE PREFERRED EMBODIMENT

Figure 1:
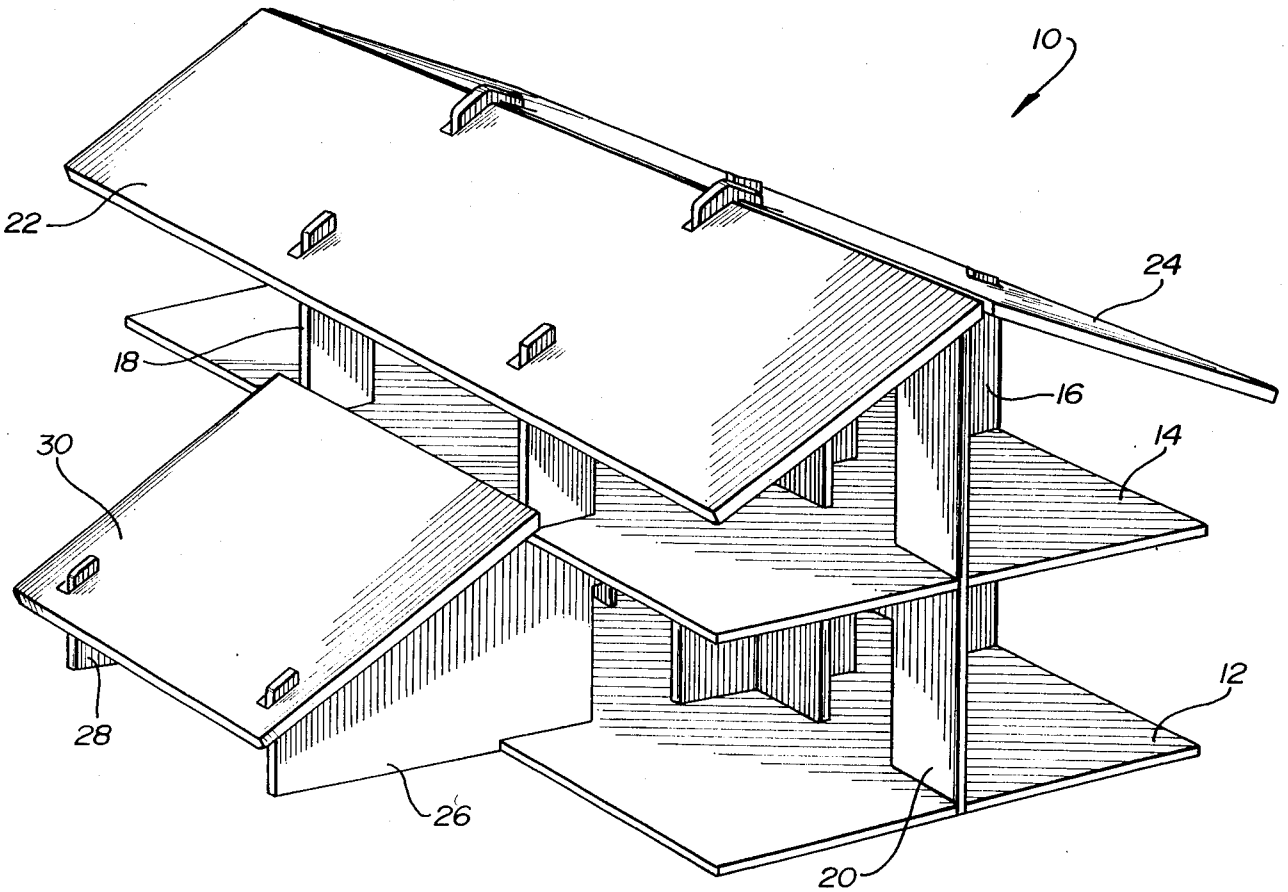
FIG. 1 is a perspective view of the playhouse.

Referring to the drawing, the playhouse 10, shown assembled in FIG. 1, is a preferred embodiment of the invention. It comprises a base, or floor 12, a second floor 14, two vertical partitions 16 and 18 (only one is necessary and the playhouse may be constructed with only one), a transverse or longitudinal partition 20, roof panels 22 and 24 and, in the embodiment shown, a carport including side panels 26, 28 which may be extensions of vertical partitions 16 and 18, and a roof 30.

Figure 2:
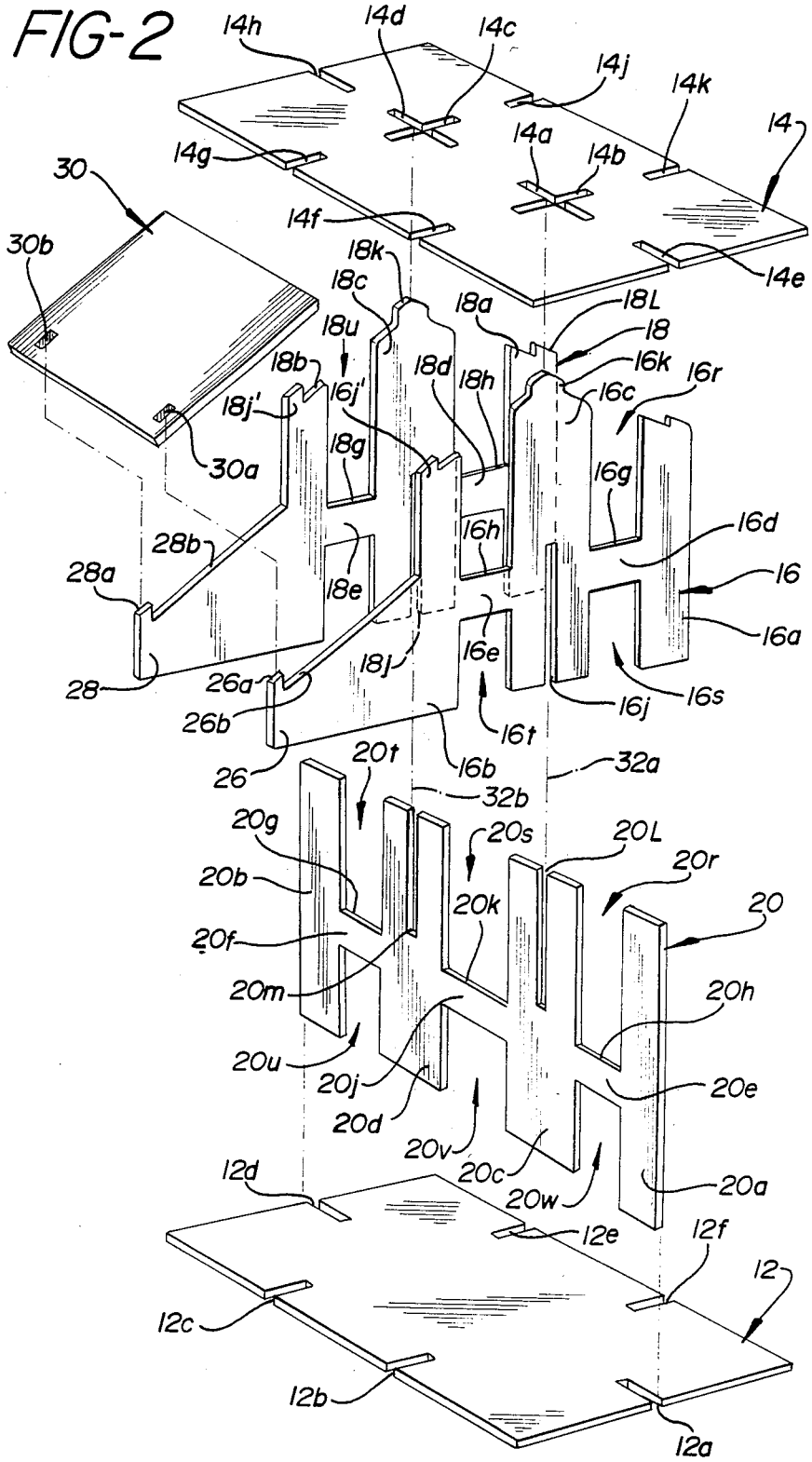
FIG. 2 is an exploded view of the playhouse, without the roof, showing the relationship of the various structural elements.
Figure 3:
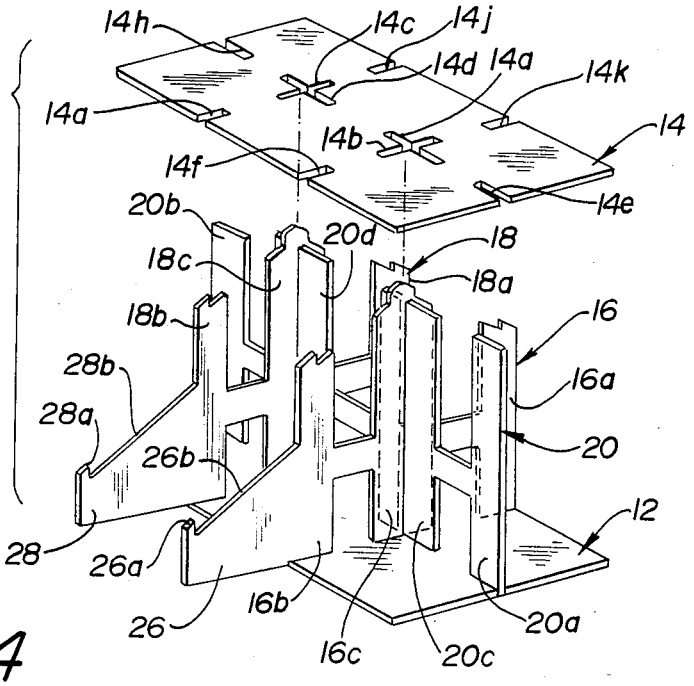
FIG. 3 is a view of the playhouse, partially assembled, showing the relationship of the parts during assembly.

As can be more clearly seen from FIG. 2, each of the vertical partitions has outer portions 16*a*, 16*b*, and 18*a*, 18*b* at opposite sides of the center line 32*a* and 32*b*, respectively, having horizontal surfaces 16*g*, 16*h* and 18*g*, 18*h*.

The center portions of the vertical partitions 16, 18 also have slots 16*j*, 18*j*. A transverse wall or partition 20 has two end portions 20*a*, 20*b* separated from two center or inner portions 20*c*, 20*d* by connecting pieces 20*e*, 20*f* each of which have horizontal upper surfaces 20*g* and 20*h*. Center portions 20*c* and 20*d* are separated by a connecting portion 20*j* having an upper horizontal surface 20*k*. Each center portion 20*c*, 20*d* has a slot 20*l*, 20*m* in the upper portion.

Thus, the center portions 16*c*, 16*d* of vertical partitions 16, 18 can slide over center portions 20*c*, 20*d* of transverse partition 20 so that slots 16*j*, 16*k* engage the lower portions of those center portions while slots 201, 20*m* engage the upper portions of partitions 16*c*, 16*d* and together form interlocking cross members. It should be understood that only one vertical partition, rather than two that are shown, are necessary to form an interlocking cross member which, as about to be described, together with horizontal floor member 14 provides structural rigidity to the assembly.

Horizontal member 14 is provided with crossed passageways 14*a*, *b*, *c* and *d* which register with cross members formed by center portions 16*c*, 20*c* and 18*c*, 20*d*. Horizontal member 14 is also provided with slots, or passageways 14*e*, *f*, *g*, *h*, *j* and *k* in the periphery which register with the outer portions 20*a*, 16*b*, 18*b*, 20*b*, 18*a*, and 16*a* respectively of the vertical and transverse panels 16, 18 and 20. Thus, when horizontal member 14 is placed over the upper portions of partitions 16, 18 and 20, the upper portions will extend through the crossed passageways and through the slots in the periphery. The horizontal member will then rest on horizontal surfaces 16*g*, *h*, 18*g*, *h* and 20*g*, *h* and *k*. Together, horizontal member 14 and partitions 16, 18 and 20 provide structural rigidity because of their interlocking relationship.

To provide added rigidity, a floor piece 12 having slots, or passageways, 12*a*, *b*, *c*, *d*, *e*, *f*, and *g* in the periphery in registry with the lower outer sections 20*a*, 16*b*, 18*b*, 20*b*, 18*a*, and 16*a* respectively of the vertical panels receives those sections.

Figure 4:
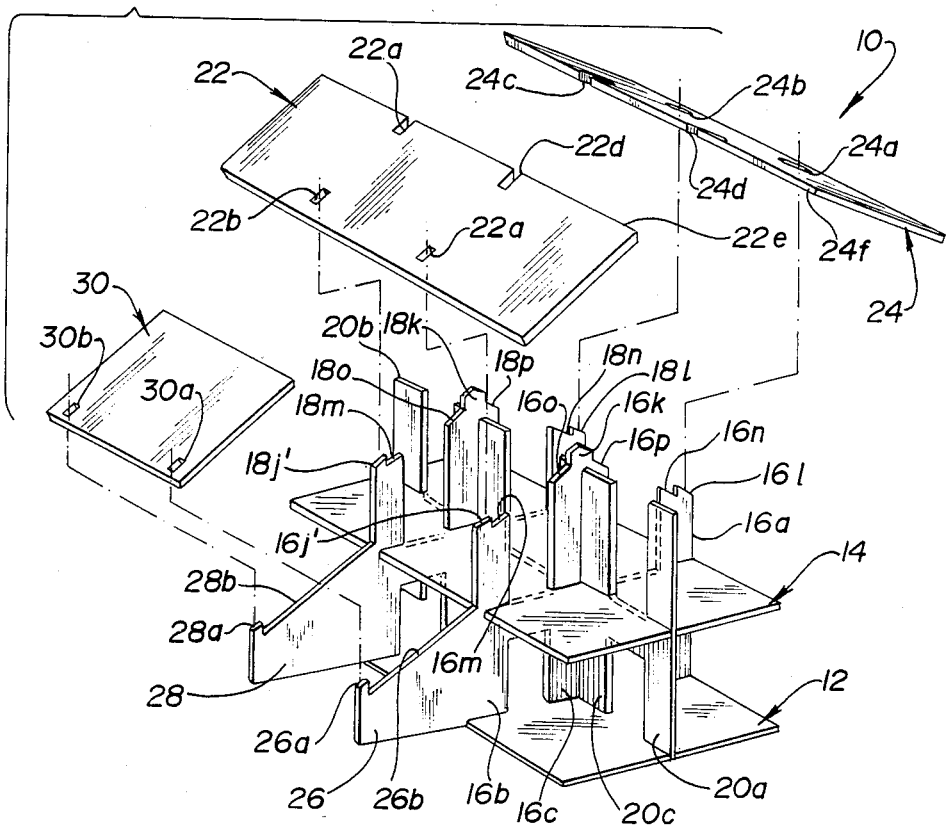
FIG. 4 shows the components of FIG. 3 in their assembled position with roof panels in an exploded relationship.

To add further rigidity to the structure, roof panels 22, 24 (FIG. 4) have slots 22*a*, *b*, *c*, and *d*, and 24*a*, *b*, *c*, and *d* through which the upper portions of sections of the vertical partitions 16, 18 and 20 extend. The upper portions of vertical partitions 16, 18 have shoulders 16*j*, *k*, and *l* and 18*j*, *k*, and *l*. When roof panel 22 is placed over the upper portions of partitions 16, 18, shoulders 16*j* and 18*j* will extend through slots 22*a*, *b* respectively and the panel will rest on slanting surfaces 16*m*, 18*m* Similarly, when roof panel 24 is placed over the upper portions of partitions 16, 18, shoulder portions 161 and 181 will extend through slots 24*a, b* and will rest on slanting surfaces 16*n*, 18*n*. The upper portions of center sections 16*c* and 18*c* also have shoulders 16*k* and 18*k*, respectively, which will now extend through slots 22*c, d* and 24*c,d* in roof panel 22, 24, the edges 22*e* and 24*f* of which are bevelled to forming a mating surface, and will rest on slanting surfaces 16*o, p* and 18*o, p* respectively.

In the embodiment shown, the playhouse has a carport formed by lateral extensions 26, 28 of partitions 16, 18. Each of these lateral extensions has a projecting shoulder 26*a*, 28*a*, respectively which extend through slots 30*a, b*, respectively, so that the roof panel rests on sloping surfaces 26*b* and 28*b*.

To assemble the playhouse, floor 12 is placed on a flat surface and partition 20 is placed with sections 20*a, b* in registry with slots 12*a, d* in the floor, and in an upright position. Partitions 16 and 18 are placed transverse to partition 20 with slots 16*j*, 18*j* in registry with slots 20*l, m* respectively, and slid down over partition 20 so that the sides of slots 16*j*, 18*j* engage the lower portions of the center sections 20*c, d* and sides of 20*l, m* engage the upper portions of those center sections. Horizontal member 14 is then placed transverse to vertical sections 16 and 18 with crossed passageways 14*a, b* and 14*c, d* in registry with upper center portions 16*c* and 18*c* of the vertical portions and slid down until the horizontal member rests on horizontal surfaces 16*g, h*, 18*g, h* and 20*g, h* and *k* which will now support the horizontal member forming a second floor of the playhouse. Roof panels 22, 24 are then placed over the tops of the vertical panels so that 16*j, k, l*, and 18*j, k, l* extend through slots 22*a*, 22*d*, 24*d*, 24*c* and 22*b, c*, 24*d* and *b* respectively and rest on slanting surfaces 16*l, m, o*, and *p* and 18*l, m, o*, and *p*. Finally, roof panel 30 is placed over extensions 26 and 28 so that shoulders 26*a* and 28*b* extend through slots 30*a* and 30*b* and the panel rests on sloping surfaces 26*b*, 28*b*.

It is thus seen that all parts are flat pieces which may be wood, masonite, plywood, or any other material of suitable structural rigidity. All parts are cut, or punched to provide the cut-outs or passageways and slots. The cut-outs 16*r, s, t*, 18*u*, 20*r, s, t, u, v*, and *w* form doorways. No exterior walls are necessary to provide rigidity thus leaving the interior open for the placement of furniture or other appurtenances.

The playhouse, likewise, is easily disassembled by removing the roof panels 22, 24, and 30, lifting the horizontal member 14 forming the second floor, and lifting the vertical panels 16, 18 leaving only vertical panel 20 standing on the floor 12, which can be removed simply by lifting it out of slots 12*a* and *d*. Disassembled, all pieces lie flat and thus occupy a minimum of space.

In its assembled state, structural rigidity is assured by the interlocking relationship of all structural members. No fastening means are required and are unnecessary. Once assembled, the playhouse can be carried from place to place without collapsing. No tools are required for assembling or disassembling which can be performed by a child of tender years.

It will also be obvious to one skilled in this art that various other designs of a playhouse embodying the principles of the invention as described in this specification may be made and used. Therefore, the invention is not limited to the embodiment shows and described herein but is limited only to the following claims which define the invention.

What is claimed is:

1. A playhouse comprising:

a. a first vertical structural member;

b. a second vertical structural member;

c. said second vertical structural member adapted to coact with said first vertical structural member to form a self-standing cross member;

d. a horizontal structural member having passages therein adapted to register with the cross members formed by the coaction of the first vertical structural member and the second vertical structural member;

e. said first vertical member and said second vertical structural member having horizontal support surfaces adapted to coact with each other to provide intersecting horizontal support surfaces;

f. at least one of said first and second vertical support members having vertical portions spaced apart from one another and adapted to register with coacting slots in the periphery of said horizontal member to add rigidity to the assembled horizontal and vertical members.

2. A playhouse as claimed in claim 1 including a roof panel having slots therein;

the spaced vertical portions of one of the vertical structural members having projecting end portions adapted to extend through the slots in the roof panel and coact with the roof panel to fix the roof panel relative to the other members of the structure.

3. A playhouse as claimed in claim 2 including a second horizontal structural member forming a base for said playhouse, said second member having slots in the periphery thereof to receive and coact with end portions of the vertical structural members.

4. A playhouse as claimed in claim 1 wherein the first and second vertical members each have a first vertical portion having a slot therein which engages a horizontal surface of the slot in the other vertical member, said slots each having vertical surfaces adapted to coact with the other vertical member and form a cross piece.

5. A playhouse as claimed in claims 1 or 4 wherein said horizontal member has crossed slots in registry with said first and second vertical members forming the cross piece.

6. A playhouse as claimed in claim 3 wherein the first horizontal member constitutes a second floor of said playhouse.

7. A playhouse as claimed in claim 2 wherein one of said vertical portions of one of the vertical members is longer than another vertical portion whereby when said roof panel is positioned over the ends of said vertical portions, the roof panel slopes;

each of said vertical portions of said vertical member having a shoulder portion extending through the slots in said roof panel, said shoulder portion retaining said roof panel and adding rigidity to the structure.

8. A playhouse comprising:

a. a first vertical structural member;

b. a second vertical structural member;

c. a third vertical structural member;

d. said third vertical structural member adapted to coact with said first and second structural members to form self-standing cross members;

e. a horizontal structural member having passages therein adapted to register with the cross members formed by coaction of said first and second cross members with said third vertical structural member;

f. said first and second vertical structural members having horizontal support surfaces adapted to coact with corresponding horizontal support surfaces of said third vertical support member to provide intersecting horizontal support surfaces;

g. each of said first, second, and third vertical support members having vertical portions separated from one another which are adapted to register with coacting slots in the periphery of said horizontal member to add rigidity to the assembled horizontal and vertical members.

9. A playhouse as claimed in claim 8 including a roof panel having slots therein and said first and second vertical members have vertical portions with end portions adapted to extend through the slots in the roof panel and fix the roof panel relative to the other members of the structure.

10. A playhouse as claimed in claim 9 wherein each of said first and second vertical structural members has at least one outer vertical portion shorter than another vertical portion and each of said vertical portions has a shoulder end portion which is adapted to extend through the slots in the roof panel whereby the roof panel can slope relative to the horizontal structural member.

11. A playhouse as claimed in claim 8, 9, or 10 including a second horizontal member having slots in the periphery thereof in registry with the first, second and third structural members and which coact therewith to provide added structural rigidity, said second horizontal member forming a base for said playhouse.

12. A playhouse as claimed in claim 8, 9, or 10 wherein said first and second structural members each have a central vertical portion spaced from an outer vertical portion forming a passageway therein.

13. A playhouse as claimed in claim 8, 9, or 10 wherein said first and second structural members each have a central vertical portion extending higher than and spaced from outer vertical portions;

each of said vertical portions having a shoulder portion extending from an end thereof; and at least two roof panels each having slots therein in registry with said extending shoulder portions and adapted to coact therewith to provide a peaked roof for said playhouse.

14. A playhouse as claimed in claims 8, 9, or 10 wherein said first and second structural members each have a central vertical portion extending higher than and spaced from outer vertical portions;

each of the first and second vertical structural members having a vertical end portion having a sloping edge extending away from said horizontal structural member;

each of said end vertical portions having a shoulder portion extending above said sloping edge at the end thereof remote from said horizontal structural member;

first and second roof panel each having slots therein in registry with the shoulder portions at the ends of said outer vertical portions to coact therewith and form a peaked roof for said playhouse; and a third roof panel having slots therein in registry with the shoulder portions extending above said sloping edge and coacting therewith to provide a sloping roof forming with said vertical end portions an enclosure open at one end.

15. A playhouse as claimed in claim 8 wherein said horizontal member has crossed slots in registry with said first and second vertical members.

16. A method of assembling a playhouse comprising the steps of:

a. placing a first structural member having a longitudinal slot therein and supporting surfaces transverse to said slot in an upright position;

b. placing a second structural member having a longitudinal slot therein and supporting surfaces transverse to said slot in an upright position transverse to said first structural member with the first and second structural members inserted into the slot in the other member to form a self-standing cross-member; and c. placing a third structural member having crossed passageways therein and slots in the periphery thereof transverse to said first and second structural members with said first and second structural members extending through said crossed passageways and through the slots in the periphery thereof and over said transverse supporting surfaces to form a rigid assembly.

17. A method of assembling a playhouse as claimed in claim 16 further including the step of placing a roof panel having slots therein over projecting end portions of one of said first and second structural members.

18. A method of assembling a playhouse comprising the steps of:

a. placing on a relatively flat surface a first horizontal member having slots on its opposite sides in the periphery thereof;

b. placing a first vertical structural member having vertical portions in registry with the slots in opposite sides of said first horizontal member, said first vertical structural member having a central vertical section spaced apart from said vertical portions and having a longitudinal slot therein, said first vertical structural member having horizontal supporting surfaces between the central vertical section thereof and the vertical portions thereof coaxial with the slots in the horizontal member which are in registry with the said vertical portions;

c. placing a second vertical member having vertical portions in registry with slots in opposite sides of the first horizontal member and transverse to said first vertical structural member, said second vertical structural member having a central vertical section spaced apart from said vertical portions thereof, said central section of the second vertical structural member having a longitudinal slot therein in registry with the slot in the central vertical portion of the first vertical member to thereby form a self-sustaining cross member, said second vertical structural member having horizontal supporting surfaces between the central vertical section thereof and the vertical portions thereof coaxial with the slots in the horizontal member which are in registry with the said vertical portions;

d. placing a third structural member having crossed passageways therein and slots in the periphery thereof transverse to said first and second structural members and parallel to said first horizontal member with the central vertical portions of said first and second structural members extending through said crossed passageways and with the vertical portions thereof spaced from said central portions extending through the slots in the periphery of said horizontal member; and e. lowering said third structural member over said supporting surfaces to form a rigid assembly.

19. A method assembling a playhouse as claimed in claim 18 including the additional step of placing a roof panel having slots therein over projecting end portions of said first and second structural members.

20. A method of assembling a playhouse as claimed in claims 18 or 19 further including the step of placing a third structural member parallel to said first structural member and in registry with slots in opposite sides of said first horizontal member.

21. A method of assembling a playhouse as claimed in claims 18 or 19 further including the step of placing at least two roof panels between the projecting ends of said central vertical portions and the vertical portions of one of the vertical portions spaced therefrom to form a peaked roof.

22. A kit which can be assembled into a playhouse comprising a plurality of flat structural members, at least two of said structural members each having a portion with a slot therein for receiving the other structural member and at least one portion thereof spaced from the portion with the slot and separated therefrom by a surface portion whereby said members can be placed with their respective slots in registry with the other member to form a self-standing cross member and the surfaces form intersecting supporting surfaces, and at least one other member having passages therein adapted to register with said two structural members which can form the self-standing cross member, and slots in the periphery thereof to receive portions of the first two members.

23. A kit as claimed in claim 22 further including a fourth member having slots therein, the spaced portions of at least one of the first two members having projections and portions adapted to extend through the slots in said fourth member.

24. A kit as claimed in claim 23 including a fifth member having slots therein, the spaced portions of at least one of the first two members having projecting end portions adapted to extend through the slots in said fourth and fifth members, said fourth and fifth members each having at least one beveled edge adapted to mate with the beveled edge of the other to form a v-shaped assembly.

25. A kit as claimed in claim 23 further including a sixth member having slots in the periphery thereof for receiving portions of the first structural members.

26. A kit which can be assembled into a playhouse comprising:

a. first and second flat structural members each having a central structural portion with a longitudinal slot therein spaced from outer structural portions, said central structural portions having a longitudinal dimension greater than the longitudinal dimensions of the outer structural portions, said outer portions having longitudinal dimensions greater than the portions separating the outer portions and the central portion;

b. a third flat structural member having central structural portions spaced from outer structural portions, said central and outer structural portions having longitudinal dimensions greater than those of the portions intermediate said outer and central structural portions, each of said central portions of the third member having a slot therein for receiving the central portions of the first and second structural members and adapted to be received by the slots in the central portions of the first and second structural members to form an interlocking assembly, c. a fourth structural member having passages therein for receiving said first, second and third members and adapted to rest on the surfaces of the portions thereof intermediate the central and outer portions thereof, said fourth member having slots in the periphery adapted to register with the outer portions of said first, second and third members to form a rigid self-standing, interlocking assembly.

* * * * *

UNITED STATES PATENT AND TRADEMARK OFFICE

CERTIFICATE OF CORRECTION

PATENT NO. : 4,569,664

DATED : February 11, 1986

INVENTOR(S) : Jerry F. Giampetruzzi, et al

It is certified that error appears in the above-identified patent and that said Letters Patent is hereby corrected as shown below:

Column 7, line 56, claim 14, should read --each of said vertical end portions having a shoulder--.

Column 9, line 5, claim 19, --of-- should have been inserted after "method".

Signed and Sealed this

*Fifteenth* Day of *July 1986*

[SEAL]

*Attest:*

DONALD J. QUIGG

*Attesting Officer*

*Commissioner of Patents and Trademarks*